US005595201A

United States Patent [19]

Dobrez et al.

[11] Patent Number: 5,595,201

[45] Date of Patent: Jan. 21, 1997

[54] APPARATUS AND METHODS FOR AUTOMATICALLY CLEANING MULTIPLE PIECES OF EQUIPMENT

[75] Inventors: Daniel J. Dobrez, Homewood, Ill.; Robert J. Rybarski, Hebron, Ind.

[73] Assignee: Dober Chemical Co., Midlothian, Ill.

[21] Appl. No.: 349,662

[22] Filed: Dec. 5, 1994

[51] Int. Cl.[6] ..... B08B 13/00

[52] U.S. Cl. ..... 134/57 D; 134/94.1; 134/96.1; 134/95.3; 68/207; 222/651

[58] Field of Search ..... 134/57 R, 94.1, 134/96.1, 100.1, 56 D, 57 D, 95.3; 222/134, 282, 370, 144.5, 639, 651; 68/17 R, 207

[56] References Cited

U.S. PATENT DOCUMENTS

| | | |
|---|---|---|
| 2,312,950 | 3/1943 | Zimarik . |
| 2,514,000 | 7/1950 | Kent . |
| 2,647,384 | 8/1953 | Erlanger . |
| 3,038,639 | 6/1962 | Anderson . |
| 3,044,285 | 7/1962 | Koplin . |
| 3,139,238 | 6/1964 | Norstrud et al. . |
| 3,163,149 | 12/1964 | Ivey . |
| 3,223,285 | 12/1965 | Anderson . |
| 3,435,834 | 4/1969 | Cooper . |
| 3,653,234 | 4/1972 | Gillespie . |
| 3,672,391 | 6/1972 | Livingston et al. . |
| 3,707,160 | 12/1972 | Query . |
| 3,771,333 | 11/1973 | Jurjans . |
| 3,799,396 | 3/1974 | Ashmead et al. . |
| 3,802,447 | 4/1974 | Bender . |
| 3,804,297 | 4/1974 | Jurjans . |
| 3,833,417 | 9/1974 | Grisparis . |
| 3,881,328 | 5/1975 | Kleinola et al. . |
| 3,896,827 | 7/1975 | Robinson . |
| 3,901,408 | 8/1975 | Boden et al. . |
| 3,916,924 | 11/1975 | McGowan . |
| 4,164,960 | 8/1979 | Howard . |
| 4,213,796 | 7/1980 | Shaffer . |
| 4,277,290 | 7/1981 | Andrews et al. . |
| 4,278,132 | 7/1981 | Holstetter . |
| 4,293,211 | 10/1981 | Kaufmann . |
| 4,307,741 | 12/1981 | Rossi . |
| 4,312,463 | 1/1982 | Daby . |
| 4,445,522 | 5/1984 | Schmid . |
| 4,646,768 | 3/1987 | Tanaka et al. . |
| 4,653,010 | 3/1987 | Figler et al. . |
| 4,687,121 | 8/1987 | Copeland . |
| 4,817,653 | 4/1989 | Krajicek et al. . |
| 4,915,119 | 4/1990 | Franklin . |
| 5,282,889 | 2/1994 | Franklin . |

FOREIGN PATENT DOCUMENTS

| | | |
|---|---|---|
| 533941 | 2/1941 | United Kingdom . |

OTHER PUBLICATIONS

Model 500 Two–Tank Hot Water Sanitizing/CIP System Data Sheet, 1990.

Klenzmation Model 300 Portable CIP/Hot Water Sanitizing Unit Data Sheet, 1981.

(List continued on next page.)

*Primary Examiner*—Frankie L. Stinson
*Attorney, Agent, or Firm*—Frank J. Uxa

[57] ABSTRACT

Apparatus and methods for providing at least one chemical composition useful to treat, e.g., clean, acidify, sanitize and the like, one or more pieces of equipment are provided. The present apparatus comprise a reservoir, at least one concentrate pump, a flow assembly and a control assembly. The concentrate pump or pumps are adapted to pump, at a controlled, preferably substantially continuously controlled, time rate and at a controlled time the concentrated form of a chemical composition from an associated reservoir. An important feature of the apparatus is the ability of the control assembly to, automatically and independently of the diluent (water) flow, control the time rate at which the concentrated form of the chemical composition exits the reservoir. This ability effectively enhances the utility of the present apparatus so that the apparatus may be used in widely varying applications, for example, to treat different pieces of equipment, without time consuming and imprecise manual adjustments of the concentrate pump or pumps.

16 Claims, 1 Drawing Sheet

OTHER PUBLICATIONS

Model 400 Hot Water Sanitizing System Data Sheet, 1990.
Model 1800 Single–Use Solution Recovery CIP System Data Sheet, 1990.
MP–1800 Microprocessor CIP Controller Data Sheet, 1990.
Microprocessor CIP Controllers, Part 2: Economic Laboratories, Inc., American Dairy Review, Jul., 1980.
Hot CIP Cleaning Becomes a Necessity, Beverage World, 1981.
Klenzmation CIP Systems Data Sheet 1981.
J. Hyde, "New Developments in CIP Practices", Chemical Eng. Progress, Jan. 1985, pp. 39–41.
Clean–in–place sanitation in the beverage industry, Beverage Ind. 1978–79 Annual Manual, L. Remonsnyder.
Model 300 Semi–automatic Portable CIP/Hot Water Sanitizing System Data Sheet, 1990.
Model 1600 Single–Use CIP System Data Sheet, 1990.
Klenzmation Model 400 CIP Hot Water Sanitizing Unit Data Sheet, 1982.
CIP system eliminates need for caustic solution, Beverage Ind. Feb., 1983.

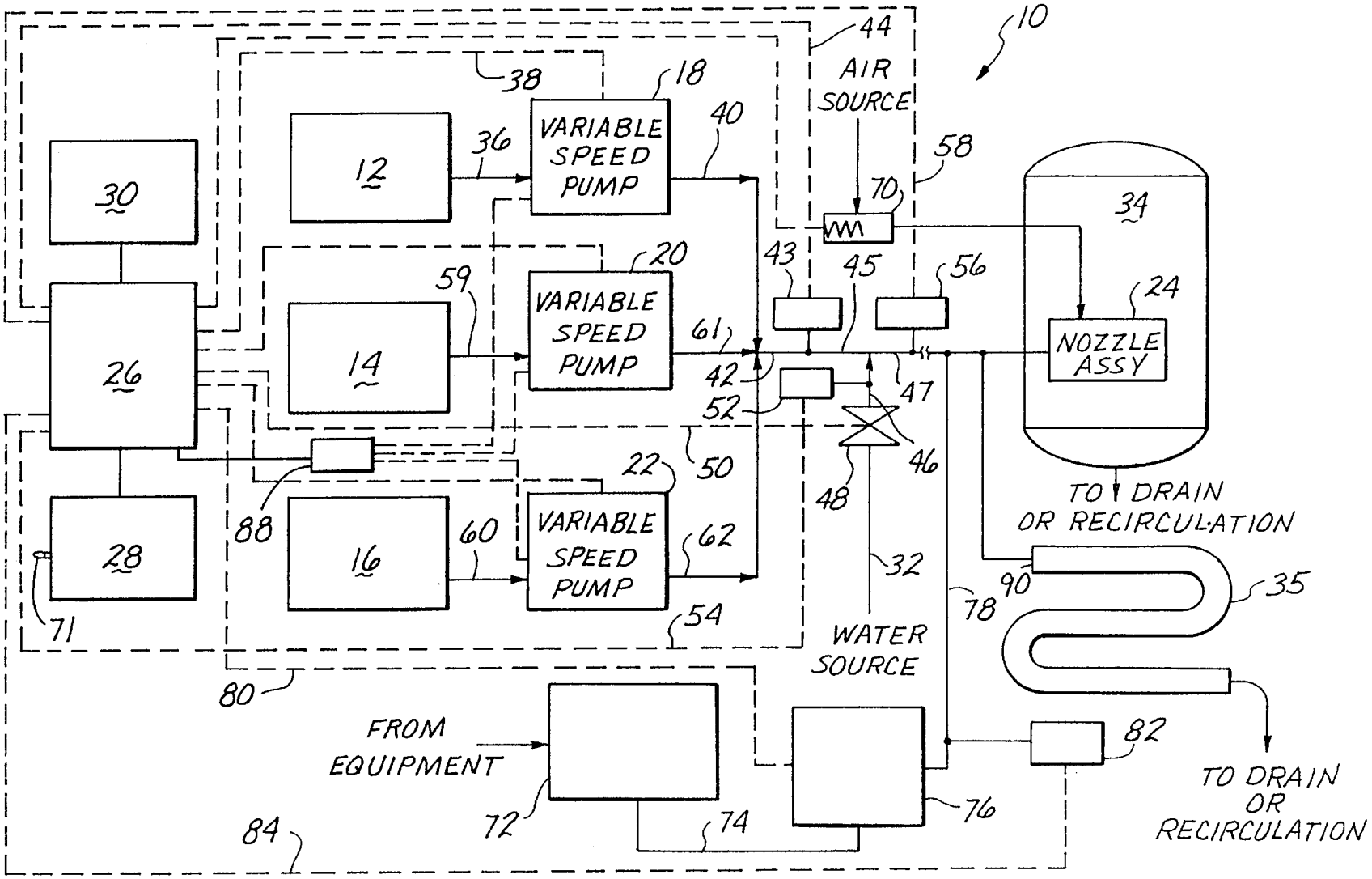
10
34
24
NOZZLE ASSY
TO DRAIN OR RECIRCULATION
35
TO DRAIN OR RECIRCULATION
82
90
78
76
58
56
47
46
32
WATER SOURCE
44
AIR SOURCE
70
45
48
43
42
52
50
40
61
62
54
74
18
20
22
VARIABLE SPEED PUMP
VARIABLE SPEED PUMP
VARIABLE SPEED PUMP
38
36
59
60
12
14
16
FROM EQUIPMENT
72
88
80
84
30
26
28
71

APPARATUS AND METHODS FOR AUTOMATICALLY CLEANING MULTIPLE PIECES OF EQUIPMENT

BACKGROUND OF THE INVENTION

This invention relates to apparatus and methods for providing one or more chemical compositions useful to treat, e.g., clean, multiple pieces of equipment. More particularly, the invention relates to apparatus and methods for automatically providing one or more chemical compositions useful to treat multiple pieces of equipment in which the compositions are provided at controlled time rates so as, for example, to automatically satisfy the different requirements to effectively treat the different pieces of equipment.

Various pieces of equipment, such as storage tanks, pipelines, stationary equipment and the like, require periodic treating, e.g., cleaning, acidifying, sanitizing and the like, to be in good working order. This is particularly true in food processing plants and pharmaceutical production facilities. Since much, if not all of the process equipment used is stationary or permanently in place, the treating of this equipment is done with the equipment in place. The systems which perform the treating operations are commonly known as clean-in-place units.

Franklin U.S. Pat. No. 4,915,119 discloses very useful systems for treating a piece of equipment. This system, which is preferably portable, that is can be moved from one area to another area to treat a piece of equipment permanently located in each area, employs an automatic processor to control the sequence of treating a piece of equipment.

In general, the Franklin system is very effective for treating a single piece of equipment, and represents a substantial advance in the "clean-in-place" art.

The pumps specifically disclosed in Franklin U.S. Pat. No. 4,915,119 provide the chemical composition or compositions to the piece of equipment to be treated at a constant time rate, that is at a constant volume per unit time. When it is desired to treat another piece or equipment after the first piece of equipment has been treated, the operator manually adjusts the pump or pumps to provide that the time rate provided by the pump or pumps satisfies the requirements of the new application. This manual adjustment is time consuming, imprecise, and subject to human error. It would be advantageous to provide a clean-in-place system which automatically adjusts the time rates at which the treating composition or compositions are provided to the piece or pieces of equipment to be treated.

SUMMARY OF INVENTION

New apparatus and methods for providing at least one chemical composition useful to treat, e.g., clean, acidify, sanitize and the like, one or more pieces of equipment have been discovered. The present systems very conveniently and effectively control the time rate at which the chemical composition or compositions, and preferably the diluent, are provided to the equipment to be treated. In a particularly useful embodiment, the present systems control such time rate or rates on a substantially continuous basis. The present automatic time rate control feature enhances the utility and efficiency of clean-in-place systems, while insuring that the treating needs or requirements of each piece of equipment are fully met and such equipment is effectively treated. The present apparatus are preferably portable, thus allowing such units to be brought into the proximate area where the individual piece or pieces of equipment to be treated are located.

In one broad aspect, the present invention is directed to apparatus useful for providing a chemical composition to treat one or more pieces of equipment. The present apparatus comprise a reservoir, a concentrate pump, a flow assembly and a control assembly. The reservoir is adapted for containing a concentrated form of the chemical composition and has an outlet through which the concentrated form of the chemical composition exits the reservoir. The concentrate pump is adapted to pump, at a controlled, preferably substantially continuously controlled, time rate and at a controlled time, the concentrated form of the chemical composition from the reservoir. The flow assembly is coupled to the concentrate pump and a source of diluent. The flow assembly is adapted for providing at a time rate, preferably at a controlled time rate and more preferably a substantially continuously controlled time rate, and at a controlled time, diluent from the source of diluent to the piece of equipment to be treated, and for providing, at a time rate, preferably at a controlled time rate and more preferably a substantially continuously controlled time rate, and at a controlled time, a chemical composition comprising the diluent from the source of diluent and the concentrated form of chemical composition from the reservoir to the piece of equipment to be treated. The control assembly is associated with the concentrate pump and the flow assembly and is structured to automatically, and independently of the diluent flow, control the time rate at which the concentrated form of chemical composition exits the reservoir and control the time during which the concentrated form of the chemical composition exits the reservoir, and to automatically and independently control the time of flow, and preferably control the time rate, of flow of the diluent in the flow assembly.

An important feature of the present apparatus is the ability of the control assembly to automatically and independently of the diluent flow control the time rate at which the concentrated form of the chemical composition exits the reservoir. This ability effectively enhances the utility of the present apparatus so that the apparatus may be used in widely varying applications, for example, to treat different pieces of equipment, without manual adjustment of the concentrate pump. To illustrate, one piece of equipment to be treated by the present apparatus may require that the flow rate of the chemical concentrate from the reservoir be at the rate of 2.5 gallons per minute. Another piece of equipment may require that the flow rate of the chemical concentrate from the reservoir be at the rate of 5.0 gallons per minute. Previous practice has been that before the second piece of equipment is treated, the chemical concentrate pump is manually adjusted to increase the flow rate from 2.5 gallons per minute to 5.0 gallons per minute. However, using the present apparatus, the concentrate pump is automatically controlled to change the flow rate from 2.5 gallons per minute to 5.0 gallons per minute. This automatic time rate control is preferably performed by imputing control information into the control assembly which effectively and automatically changes the flow rate of the pump, as desired.

In a particularly useful embodiment, the reservoir, concentrate pump, flow assembly and control assembly are included in a portable system adapted to be moved to another location to treat another piece of equipment in the other location. In this embodiment, the source of diluent, for example, the water source, is not included in the portable system.

The control assembly is preferably structured to automatically and independently control, more preferably substantially continuously control, the time rate at which the diluent flows from the source of diluent to the piece of equipment to be treated.

In a particularly useful embodiment, the control assembly includes an electronic controller, for example, a central processing unit (CPU) or a computer, which is structured to be present by imputed control information to perform the various control functions described herein. Signals are sent from the electronic controller, for example, to the concentrate pump and the flow assembly, to effect the desired control. The electronic controller preferably includes a keyboard and a display module, for example, an operator interface panel, and is structured to be preset by control information imputed through the keyboard. The display module is adapted to provide a visual display of the control information imputed through the keyboard.

In one embodiment, the control assembly includes at least one monitoring assembly located downstream from the reservoir to monitor a time rate dependent characteristic of the concentrated form of the chemical composition flowing in the flow assembly. The at least one monitoring assembly preferably comprises a flow meter and/or an electrical conductivity meter. Preferably, the control assembly includes a diluent monitoring assembly located downstream from the source of diluent to monitor a time rate dependent characteristic of the diluent flowing in the flow assembly. This diluent monitoring assembly preferably comprises a flow meter.

The control assembly preferably includes an electronic controller structured to receive additional control information from the at least one monitoring assembly and to send a signal to the concentrate pump to control the time rate at which the concentrated form of the chemical composition is pumped from the reservoir. The control assembly preferably includes an electronic controller structured to receive additional control information from the diluent monitoring assembly and to send a signal to the flow assembly to control the time rate at which the diluent is provided from the source of diluent. More preferably, the flow assembly includes a control valve adapted to receive a signal from the electronic controller and, based on this signal, control the time rate at which the diluent is provided from the source of diluent.

The flow assembly is adapted to provide the diluent and the chemical composition on a once through basis or on a recirculated or recycle basis. In one embodiment, the present apparatus further comprises a recirculation tank adapted to receive diluent and the chemical composition from the piece of equipment being treated, and a recirculation pump located and adapted to pump diluent and the chemical composition from the recirculation tank to the piece of equipment being treated. The control assembly preferably controls the time rate at which the recirculation pump pumps. Preferably, the reservoir, concentrate pump, flow assembly, control assembly, recirculation tank and recirculation pump are included in a portable system adapted to be moved to another location to treat another piece of equipment in the other location.

In one particularly useful embodiment, the present apparatus includes a plurality of reservoirs and a plurality of concentrate pumps which are adapted to provide a plurality of different chemical compositions useful to treat a piece of equipment. In this embodiment, the flow assembly is coupled to the concentrate pumps and the source of diluent and is adapted for providing, at a time rate and at a controlled time, diluent from the source of diluent to the piece of equipment being treated, and for providing, at a controlled time rate and at a controlled time, each of a plurality of chemical compositions, each of which comprises diluent from the source of diluent and a concentrated form of the chemical composition from the reservoir containing the concentrated form of this chemical composition, to a piece of equipment being treated. In addition, in this embodiment, the control assembly is associated with the reservoirs and the flow assembly and is structured to, automatically and independently of the diluent flow, control the time rate at which the concentrated form of chemical composition exits from each of the reservoirs, to control to the time in which the concentrated form of chemical composition exits from each of the reservoirs, and to automatically and independently control the flow of diluent in the flow assembly.

Further, the control assembly is preferably structured to control the time in which the chemical concentrate exits each individual reservoir such that a predetermined sequence of individual chemical compositions is provided, for example, to the equipment being treated.

An important feature of the present invention is that the chemical concentrate pump or pumps are controlled automatically to vary the time flow rate of chemical composition concentrate from the reservoir or reservoirs. Thus, each such pump is preferably adapted to receive a signal, more preferably, an electronic signal, from the control assembly, to control the time rate at which the concentrate exits the reservoir associated with such pump.

The concentrate pump or pumps useful in the present invention are adapted to pump or provide concentrate from the reservoir or reservoirs at various time rates which preferably are automatically set, for example, based on control information imputed into the control assembly. In general, the presently useful pumps may be identified as variable speed or variable output pumps. Such pumps are available from many sources. A particularly useful type of pump is an electric powered, positive displacement pump in which the electric power can be varied to vary the time rate of chemical composition concentrate provided from the reservoir. Thus, the control assembly is preferably adapted to provide a separate or independent signal to each of the concentrate pumps to control the power, for example, electric power, used by the pump, thereby to control the time rate at which the chemical composition concentrate is pumped from the reservoir. An example of a useful chemical concentrate pump is that sold by Gelber Industries under the trademark Micropump.

The control assembly preferably includes a central processing unit (CPU) with an associated keyboard and monitor or operator interface panel (OIP). Through the use of the keyboard, a human operator can preset or preprogram the individual times, time rates and predetermined sequence discussed herein, as desired, into the CPU. The CPU is programmed to accept the time, time rate and sequence information which is keyed in and to automatically control the operation in accordance with this information. The human user may, for example, to satisfy to different requirements of a different treating application, reset or reprogram the times, time rates and sequence by keying new information into the CPU. However, once this information is accepted by the CPU and the cycle started, the control assembly performs its control function automatically, without human intervention. The monitoring assembly or assemblies described herein preferably function during the cycle to provide additional control information to the control assembly so that, if necessary, additional signals can be provided by the control assembly to one or more other components of the present apparatus to adjust the operation thereof so that the cycle proceeds as planned. The OIP provides a visual display of the information which is keyed in (to insure the accuracy of same) and allows the human user to monitor the operation being controlled by the control assembly.

In a further preferred embodiment, the present apparatus further comprises a nozzle assembly acting to control the contacting of the chemical composition or compositions and diluent with the piece of equipment being treated. In this embodiment, the control assembly automatically controls the movement of the nozzle assembly, for example, to improve the effectiveness of the treating operation.

The present apparatus preferably further comprises an alarm assembly capable of being preset to provide a signal warning of an abnormal condition in one or more components of the apparatus. This alarm assembly may be incorporated into the control assembly with the alarm limits or information being keyed into the CPU and the OIP providing a visual signal if a preset alarm limit is violated. The CPU may be configured to be associated with a horn or like device to provide an audible signal in the event that one or more alarm limits are exceeded.

In a further broad aspect, the present invention involves methods for providing at least one chemical composition useful to treat a piece of equipment. Such methods comprise:

(a) providing at a predetermined or controlled time rate and at a predetermined or controlled time a chemical composition concentrate, preferably a plurality of chemical composition concentrates;

(b) contacting each of the concentrates from step (a) with a diluent to form the chemical compositions;

(c) contacting a piece of equipment to be treated with the diluent and each of the chemical compositions from step (b) one or more times in a predetermined sequence; and (d) automatically controlling the time during which steps (a) and (b) occur and the time rates at which step (a) occurs, and the contacting times and sequence of step (c).

More preferably, two or three chemical compositions are employed in the present methods.

The present apparatus may be used to practice the present methods as described herein.

It is preferred that the chemical composition concentrates and chemical compositions be substantially uniform aqueous slurries or solutions, with the diluent preferably comprising water. The active material in each of the chemical compositions is preferably water dispersible or water soluble and is selected to provide the desired treatment to the equipment to be treated, for example, cleaned, acidified, sanitized and the like. Many conventional active materials which are well known in the art are suitable for use in the present invention.

These and other aspects and advantages of the present invention are set forth in the following detailed description and claims, particularly when considered in conjunction with the accompanying drawing in which like parts bear like reference numerals.

BRIEF DESCRIPTION OF THE DRAWING

The drawing is a schematic illustration showing one embodiment of the present apparatus.

DETAILED DESCRIPTION

Referring now to the drawing, a chemical composition dispensing apparatus, shown generally at 10, includes first, second and third chemical concentrate containers 12, 14 and 16, respectively; first, second and third variable speed, electric powered, positive displacement pumps 18, 20 and 22, respectively; an air driven nozzle assembly 24; a central processing unit (CPU) 26; a keyboard 28; and a monitor or OIP 30. Also included is a water line 32 which is connected by conventional fittings to a municipal water source or supply.

Each of the containers 12, 14 and 16 contains a concentrated aqueous solution of a different active material, each of which is needed to clean and treat empty storage tank 34 and empty pipeline 35 before putting the storage tank and pipeline back into service.

First container 12 includes an outlet line 36 through which a first concentrate from the first container exits. This first concentrate is pumped by first pump 18 at a time rate and time controlled automatically by CPU 26 which sends control signals to the first pump through signal line 38. All of the signal lines are shown in shadow. The first concentrate flows from first pump 18 into line 40. This first concentrate flows into line 42 where the time rate of flow of the first concentrate is monitored by concentrate flowmeter 43, which provides time rate information to CPU 26 through signal line 44. The CPU 26, based on information provided from concentrate flowmeter 43 through signal line 44, provides, if necessary, an additional control signal through signal line 38 to automatically adjust the time rate at which the first concentrate is pumped from first container 12 so that this time rate is at the desired, controlled level. This information "feedback" from concentrate flowmeter 43 occurs on a continuous basis, and CPU 26 continuously controls first pump 18 by signals through signal line 38 so that the time rate of first concentrate pumped from first container 18 is continuously controlled.

The first concentrate flows through line 45 where it is combined and mixed with water from line 46 to form a first chemical composition which flows through line 47 to nozzle assembly 24, which sprays the first chemical composition onto the interior surfaces of storage tank 34 to provide a desired treatment (cleaning).

The time and time rate of flow of water from the water source through line 32 is automatically controlled by CPU 26 and control valve 48 which receives control signals from the CPU through control line 50. The water flows past control valve 48 into line 46. The time rate of water flow is continuously monitored by water flowmeter 52 which continuously provides time rate information to CPU 26 through line 54. The CPU 26, based on information provided by water flowmeter 48 through signal line 54, provides, if necessary, an additional signal through signal line 50 to control valve 48 to automatically adjust the time rate at which water is provided from the source of water so that this time rate is at the desired, controlled level. The time rate of water provided from the source of water is continuously controlled.

As the first chemical composition flows in line 47, its electrical conductivity is monitored by conductivity meter 56, which provides electrical conductivity information to CPU 26 through signal line 58. The electrical conductivity of the first chemical composition in line 47 is related to the composition or make-up of this material and to the time rates of flow of the first concentrate and water into line 47. The CPU 26, based on information provided from conductivity meter 56 through signal line 58, provides, if necessary, an additional control signal through signal line 38 to first pump 18 to automatically adjust the time rate at which the first concentrate is pumped from first container 12 and/or an additional control signal through signal line 50 to control valve 48 to automatically adjust the time rate at which water is provided from the source of water, so that the make-up of the first chemical composition in line 47 is at the desired, controlled level. The make-up of the composition in line 47 is continuously controlled.

Similarly, second and third containers 14 and 16 include outlet lines 59 and 60, respectively, through which second and third concentrates exit second and third containers 14 and 16, respectively. These second and third concentrates are pumped by second and third pumps 20 and 22, respectively. Each of the second and third concentrates flow from lines 61 and 62, respectively, into lines 42 and 45 where it is combined and mixed with water from line 46 to form second and third chemical compositions, respectively, which flows through line 47 to nozzle assembly 24, which sprays second and third chemical compositions onto the interior surfaces of storage tank 34 to provide further desired treatments (cleanings). The time rates of the second and third concentrates are initially automatically controlled and continuously monitored and controlled in a manner similar to that described herein with respect to the first concentrate. In addition, the make-up of the second and third chemical compositions are continuously monitored and controlled in a manner similar to that described herein with respect to the first chemical composition.

The flow of the concentrates from first, second and third containers 12, 14 and 16 and the flow of water from the water source, as described above, occurs in a controlled sequence. First, second and third concentrates flow from first, second and third containers 12, 14 and 16, respectively, as described above only when first, second and third pumps 18, 10 and 22, respectively, are activated. Water from this water source flows in line 46 only when control valve 48 is opened (or activated). The sequence of treatments of storage tank 34 is controlled, at least in part, by controlling the activation/deactivation of first, second and third pumps 18, 20 and 22, and control valve 48.

Central processing unit 26 may be any conventional mini or micro computer, such as a system sold under the trademark PLC/SLC by Allen Bradley. Included within central processing unit 26 is a program module which contains a generalized computer program allowing the central processing unit 26 to send control signals independently and at predetermined times to first, second and third pumps 18, 20 and 22, and control valve 48. CPU 26 is also effective to receive and process information from the various flowmeters and the conductivity meter 56 described herein.

Keyboard 28 allows an authorized human operator to preset specific times at which the central processing unit 26 will send an "on" and an "off" signal to each of the pumps 18, 20 and 22 and control valve 48. In addition, the operator can preset specific time rates at which the first, second and third concentrates are to be pumped and water from the water source is to be provided. In other words, the human operator, using keyboard 28, keys specific time and time rate information into central processing unit 26 and thereby ultimately (as will be discussed hereinafter) presets or controls the time, the time rates and sequence in which storage tank 34 is treated by the first, second and third chemical compositions and water. As a safety measure, keyboard 28 can only be used when safety key 71 is inserted. Thus, only authorized operators are given access to key 71.

Solenoid valve 70 controls the supply of air to the air driven nozzle assembly 24. By controlling the on/off status of solenoid valve 70, central processing unit 26 effectively controls the movement of nozzle assembly 24. Movement of nozzle assembly 24 provides for more complete treatment of all interior surfaces of storage tank 34 by the chemical composition or water from line 47. One very suitable nozzle assembly 24 includes Orbijet rotary nozzles which use an air driven motor for movement in a figure eight for effective spray coverage.

After being sprayed from nozzle assembly 24, the liquid from line 47 (and debris from tank 34) collect at the bottom of tank 34 and are discarded via the drain or other environmentally acceptable route. Used in this manner, the present apparatus 10 involves a "once through" treating of storage tank 34.

Alternately, the liquid from storage tank 34 can be passed to a recirculation tank 72 where the liquid is collected for reuse or recycle back to storage tank 34. When desired, the liquid from recirculation tank 72 is pumped through outlet line 74 by variable speed, electric powered positive displacement recirculation pump 76 into line 78 and ultimately into nozzle assembly 24.

The recycle or recirculation of liquid from recirculation tank 72 is also controlled by CPU 26. Thus, the time and time rate at which recycled liquid is passed back into storage tank 34 can be controlled based upon information inputted into CPU 26. CPU 26 provides control signals to recirculation pump 76 through signal line 80. As the recycle liquid passes through line 78, the flow rate is monitored by recycle flow meter 82, which passes time rate information to CPU 26 through signal line 84. The CPU 26, based on additional information provided from recycle flow meter 82 through signal line 84, provides, if necessary, an additional control signal through signal line 80 to automatically adjust the time rate at which the recycle liquid is pumped from recirculation tank 72 so that this time rate is at the desired, controlled level. The time rate of recycle liquid from the recirculation tank 72 is continuously controlled by CPU 26 in combination with recycle flow meter 82.

Operator interface panel (OIP) 30 is associated with central processing unit 26 and keyboard 28 and allows the human operator to visually confirm the information that is keyed into the central processing unit 26 via keyboard 28. A suitable display module may be used as OIP 30. A very useful embodiment of OIP 30 is the device sold by Allen Bradley under the trademark PanelView. OIP 30 also gives a visual display of the on/off status of the various pumps and the control valve 48 and, thus, allows the human operator to monitor the progress of the treatment cycle.

Apparatus 10 also includes an alarm system 88 which monitors the status of first, second and third pumps 18, 20 and 22. Alarm system 88 is connected to central processing unit 26. Set points for alarm system 88 can be keyed into central processing unit 26 via keyboard 28. An abnormal condition (beyond the set point level) in any of the pumps 18, 20 and 22 causes the central processing unit 26 to shut off the power to all of the pumps 18, 20 and 22. In the event of such a violation of the set point setting, the alarm system 88 emits an audible signal and a visual alarm signal will be displayed on the OIP 30. An abnormal condition in pumps 18, 20 and 22 can be caused, for example, by a depleted supply of concentrate in containers 12, 14 or 16; by a ruptured line; or by excessive cavitation in the concentrate supply. Under alarm conditions, the central processing unit 26 is programmed to spray water into storage tank 34 for the duration of the preprogrammed cycle. If desired, the human operator can instruct the central processing unit 26 (via keyboard 28) to stop the cycle; remedy the cause of the shut down; and instruct the central processing unit 26 to resume the cycle where it left off.

Assuming no abnormal situations arise, apparatus 10 goes through a pre-programmed cycle or sequence of steps which results in storage tank 34 being effectively cleaned and/or treated. This sequence of steps can include one or more steps involving recycle or recirculation operation. Of course, the sequence may include only once-through operation or only recycle or recirculation operation, as desired. Apparatus 10 has the capability of being adapted to conveniently and effectively meet the requirements of widely varying applications.

One of the important features of the present apparatus 10 is the ability to clean or treat different types of equipment without manually readjusting the apparatus, in particular the concentrate pumps of the system. This is illustrated in the drawing by the treating of pipeline 35.

After the storage tank 34 has been effectively treated, it is placed back into service. The line 47 is directed to the inlet 90 of pipeline 35. Nozzle assembly 24, or another liquid distribution device, may be included in pipeline 35 to facilitate effective contacting of the chemical compositions and water with the walls of the pipeline. After this has been accomplished, an entirely different set of instructions (control information) is provided to CPU 26 through keyboard 28. This control information, which includes entirely different control information as to the times and time rates at which first, second and third concentrates and water from water source are to be pumped or provided, is chosen to optimally treat pipeline 35. No manual adjustments of apparatus 10 are required (aside from keying the control information into keyboard 28 and directing the flow from line 47 into pipeline 35).

After pipeline 35 has been effectively treated, by the pre-programmed sequence of once through and/or recycle or recirculation steps, similar to that described above with regard to storage tank 34, apparatus 10 is removed from pipeline 35 and the pipeline is placed back into service.

While this invention has been described with respect to various specific examples and embodiments, it is to be understood that the invention is not limited thereto and that it can be variously practiced with the scope of the following claims.

What is claimed is:

1. An apparatus useful for providing a chemical composition useful to treat a piece of equipment comprising:

a reservoir for containing a concentrated form of said chemical composition, said reservoir having an outlet through which said concentrated form of said chemical composition exits said reservoir;

a concentrate pump adapted to pump at a controlled time rate and at a controlled time, the concentrated form of said chemical composition from said reservoir;

a flow assembly coupled to said concentrate pump and a source of diluent and being adapted (1) for providing, at a time rate and at a controlled time, diluent from said source of diluent to a piece of equipment to be treated, and (2) for providing, at a time rate and at a controlled time, a chemical composition comprising diluent from said source of diluent and said concentrated form of said chemical composition from said reservoir to the piece of equipment to be treated; and a control assembly associated with said concentrate pump and said flow assembly and structured to, automatically and independently of the diluent flow, control the time rate at which said concentrated form of said chemical composition is pumped by said concentrate pump from said reservoir and control the time during which said concentrated form of said chemical composition is pumped by said concentrate pump from said reservoir, and to automatically and independently control the flow of diluent in said flow assembly.

2. The apparatus of claim 1 wherein said reservoir, said concentrate pump, said flow assembly and said control assembly are included in a portable system adapted to be moved to another location to treat another piece of equipment in said another location, provided that said source of diluent is not included in said portable system.

3. The apparatus of claim 1 wherein said flow assembly is adapted for providing, at a controlled time rate and at a controlled time, diluent from said source of diluent to the piece of equipment to be treated, and said control assembly is structured to automatically and independently control the time rate at which said diluent flows from said source of diluent to the piece of equipment to be treated.

4. The apparatus of claim 3 wherein said control assembly includes a diluent monitoring assembly located downstream from said source of diluent to monitor a time rate dependent characteristic of said diluent flowing in said flow assembly.

5. The apparatus of claim 1 wherein said control assembly includes at least one monitoring assembly located downstream from said reservoir to monitor a time rate dependent characteristic of said concentrated form of said chemical composition or said chemical composition flowing in said flow assembly.

6. The apparatus of claim 1 wherein said flow assembly is adapted to providing, at a time rate and at a controlled time, said chemical composition comprising diluent directly from said source of diluent and said concentrated form of said chemical composition directly from said reservoir, directly to the piece of equipment to be treated.

7. An apparatus useful for providing a plurality of different chemical compositions useful to treat a piece of equipment comprising:

a plurality of reservoirs for containing a concentrated form of a different one of said chemical compositions, each of said reservoirs having an outlet acting to provide an exit from the associated reservoir for the concentrated form of the chemical composition contained in said associated reservoir;

a plurality of concentrate pumps each of which is operatively coupled to a different one of said plurality of said reservoirs and is adapted to pump, at a controlled time rate and at a controlled time, the concentrated form of the chemical composition contained in the operatively coupled reservoir;

a flow assembly coupled to said concentrate pumps and a source of diluent and being adapted (1) for providing, at a time rate and at a controlled time, diluent from said source of diluent to a piece of equipment to be treated, and (2) for providing, at a time rate and at a controlled time, each of a plurality of chemical compositions, each of which comprises diluent from said source of diluent and a concentrated form of said chemical composition from said reservoir containing said concentrated form of said chemical composition, to the piece of equipment to be treated; and a control assembly associated with said reservoirs, said plurality of concentrate pumps and said flow assembly and structured to, automatically and independently of the diluent flow, control the time rate at which said concentrated form of said chemical composition is pumped by one of said concentrate pumps from one of said reservoirs and control the time during which said concentrated form of each of said chemical compositions is pumped by one of said concentrate pumps from one of said reservoirs, and to automatically and independently control the flow of diluent in said flow assembly.

8. The apparatus of claim 7 wherein said control assembly is adapted to control the time during which said concentrated form of each of said chemical compositions is pumped by one of said concentrate pumps from one of said reservoirs so that a controlled sequence of individual chemical compositions is provided to the piece of equipment to be treated.

9. The apparatus of 7 wherein said flow assembly is adapted for providing, at a controlled time rate and at a controlled time, diluent from said source of diluent to the piece of equipment to be treated, and said control assembly is structured to automatically and independently control the time rate at which said diluent flows from said source of diluent to the piece of equipment to be treated.

10. The apparatus of claim 7 wherein said control assembly includes at least one monitoring assembly located downstream from said reservoirs to monitor a time rate dependent characteristic of said concentrated forms of said chemical composition or said chemical compositions flowing in said flow assembly.

11. The apparatus of claim 10 wherein said control assembly includes an electronic controller structured to be preset by imputed control information, to receive additional control information from said at least one monitoring assembly and to send signals to said concentrate pumps to control the time rate at which each of said concentrated forms of said chemical composition is pumped from each of said reservoirs.

12. The apparatus of claim 7 wherein said control assembly includes a diluent monitoring assembly located downstream from said source of diluent to monitor a time rate dependent characteristic of said diluent flowing in said flow assembly.

13. The apparatus of claim 12 wherein said control assembly includes an electronic controller structured to be preset by imputed control information, to receive additional control information from said diluent monitoring assembly and to send a signal to said flow assembly to control the time rate at which said diluent is provided from said source of diluent.

14. An apparatus useful for providing a chemical composition useful to treat a piece of equipment comprising:

a reservoir for containing a concentrated form of said chemical composition, said reservoir having an outlet through which said concentrated form of said chemical composition exits said reservoir;

a concentrate pump adapted to pump, at a controlled time rate and at a controlled time, the concentrated form of said chemical composition from said reservoir;

a flow assembly coupled to said concentrate pump and a source of diluent and being adapted (1) for providing, at a time rate and at a controlled time, diluent from said source of diluent to a piece of equipment to be treated, and (2) for providing, at a time rate and at a controlled time, a chemical composition comprising diluent from said source of diluent and said concentrated form of said chemical composition from said reservoir to the piece of equipment to be treated;

a control assembly associated with said concentrate pump and said flow assembly and structured to, automatically and independently of the diluent flow, control the time rate at which said concentrated form of said chemical composition is pumped by said concentrate pump from said reservoir and control the time during which said concentrated form of said chemical composition is pumped by said concentrate pump from said reservoir, and to automatically and independently control the flow of diluent in said flow assembly; and a recirculation tank adapted to receive at least one of diluent and said chemical composition from said piece of equipment, and a recirculation pump located and adapted to pump at least one of diluent and said chemical composition from said recirculation tank to said piece of equipment.

15. The apparatus of claim 14 wherein said control assembly controls the time rate at which said recirculation pump pumps and the time said recirculation pump pumps.

16. The apparatus of claim 14 wherein said reservoir, said concentrate pump, said flow assembly, said control assembly, said recirculation tank and said recirculation pump are included in a portable system adapted to be moved to another location to treat another piece of equipment in said another location, provided that said source of diluent is not included in said portable system.

* * * * *